United States Patent [19]

Worrall

[11] 4,197,345

[45] Apr. 8, 1980

[54] FABRIC HAVING MULTIPLE SOLID COLORED STRIPES

[75] Inventor: James D. Worrall, East Greenwich, R.I.

[73] Assignee: Engineered Yarns, Inc., Coventry, R.I.

[21] Appl. No.: 939,705

[22] Filed: Sep. 5, 1978

[51] Int. Cl.² ..... D03D 15/00

[52] U.S. Cl. ..... 428/258; 139/416; 139/420 R; 156/148; 428/245; 428/255; 428/257; 428/365; 428/373

[58] Field of Search ..... 428/257, 258, 259, 365, 428/373; 156/148; 139/408, 413, 416, 417, 418, 420 R

[56] References Cited

U.S. PATENT DOCUMENTS 3,100,926 8/1963 Richmond ..... 156/148

3,434,510 3/1969 Neyret ..... 139/413

*Primary Examiner*—James J. Bell

*Attorney, Agent, or Firm*—Fleit & Jacobson

[57] ABSTRACT

A generally planar fabric having a plurality of solid colored stripes. The fabric comprises a first plurality of warp yarns having a first color, a second plurality of warp yarns having a second color different from said first color, and a plurality of transparent filling yarns. All of the yarns are interwoven according to a desired weave pattern. At the yarn crossover points or junctions of the fabric, the transparent yarns allow the colors of the warp yarns to show through. In a preferred embodiment, a multifilament core yarn encapsulated in a plastisol containing a foaming agent constitutes the warp yarns, and a multifilament transparent core yarn encapsulated in a clear plastisol constitutes the filling yarns.

42 Claims, 3 Drawing Figures

FABRIC HAVING MULTIPLE SOLID COLORED STRIPES

BACKGROUND OF THE INVENTION

1. Field of the Invention

The subject invention relates to fabrics in general and to generally planar fabrics having a plurality of solid colored stripes in particular.

2. Description of the Prior Art

A widely-used fabric for casual living furniture and accessories is an open-mesh material woven from synthetic yarn, usually utilizing a plain weave. In fabrics woven from these types of yarns, it is often desirable to improve styling by utilizing a number of colors or patterns including solid colored stripes. Stripe effects can be introduced into the fabric by alternating groups of warp and filling yarns. Although there will be one solid stripe, the other stripe, assuming two colors are used, will be of a checkerboard or two-color nature. Various techniques have been employed to produce fabrics having individually colored stripes; however, each of these techniques has certain drawbacks which produce unacceptable results, both in terms of fabric appearance and cost of fabric production.

The most common techniques for enhancing the presentation of solid colored stripes on a fabric are based upon variously using more warp yarns per inch than filling yarns, and using filling yarns which have a significantly smaller diameter than the warp yarns. Although each of these methods has enhanced the appearance of the stripe appearing on the fabric, the checkerboard still detracts from the overall appearance of the fabric. In addition, fabrics produced in accordance with these techniques do not have uniform strength and stability.

Other techniques which employ the use of warp direction floats, such as when using a satin weave, have improved stripe appearance, but the fabrics produced still suffer from strength and stability problems.

The use of small diameter yarns for both warp and filling yarns has been tried with moderate success. While the illusion of solid colored stripes is increased, the checkerboard effect is still dominant. In addition, use of the small diameter yarns greatly increases the cost of producing the fabric.

The most successful method of producing multicolor stripes, from the standpoint of overall fabric appearance, has been the use of a post-weave printing operation, in which the stripe pattern is actually printed onto the woven fabric. This method has, as its major drawback, the tremendous increase in the cost of fabric production necessitated by the printing operation.

SUMMARY OF THE INVENTION

The subject invention relates to the production of a fabric made from an open-mesh material woven from vinyl coated polyester yarns which are manufactured either by extrusion coating or by plastisol dip coating. Basically, the fabric comprises a first plurality of warp yarns having a first color, a second plurality of warp yarns having a second color different from the first color, and a plurality of transparent filling yarns. Additional groups of warp yarns may be added to provide any number of individually colored stripes. When the yarns are woven together in accordance with a desired weave pattern, a number of yarn crossover points at the intersections of warp and weft yarns are created. At these crossover points, the transparent yarns allow the colors of the warp yarns to show through, thereby producing a fabric appearance of solid colored stripes.

It is an object of the present invention to achieve a fabric appearance of solid stripes using latent foam vinyl coated yarns, particularly those yarns produced by the plastisol dip process.

It is another object of the present invention to produce a generally planar fabric having a plurality of solid colored stripes.

It is still an object of the present invention to provide an inexpensive, coarsely-woven fabric having a plurality of solid colored stripes.

It is yet another object of the present invention to provide a method for producing a generally planar fabric having a plurality of solid colored stripes.

Other objects and advantages of this invention will further become apparent hereinafter and in the drawings, in which:

DESCRIPTION OF THE PREFERRED EMBODIMENTS

Figure 1:
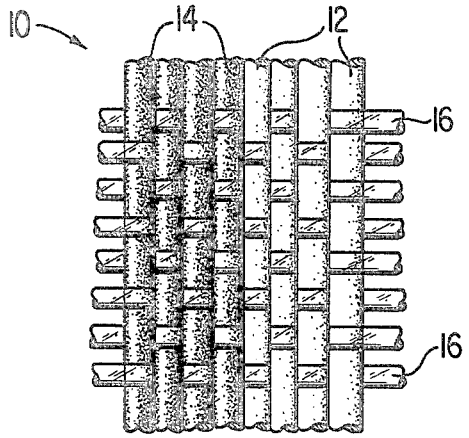
FIG. 1 is a plan view of a fabric embodying the subject invention.

In producing a fabric embodying the subject invention, certain man-made yarns, such as vinyl coated polyester yarns, are used. These vinyl coated yarns can be manufactured, either by extrusion coating or by plastisol dip coating, also referred to as a dip/die coating.

The extrusion coating process is discussed in great detail in U.S. Pat. No. 3,100,926 (Method of Producing Expanded Fabric-Like Material-E. B. Richmond), incorporated by reference herein. As discussed in that patent, the extrusion coating operation utilizes a crosshead extruder, much like wire coating, wherein a multifilament strand, such as polyester, nylon, rayon or glass is encapsulated with melted vinyl in the crosshead using a pressure or tubing die and then cooled in a water bath. There is virtually no penetration of vinyl among the yarn filaments due to the relatively high viscosity of the liquid vinyl.

In the plastisol dip coating process, as disclosed in copending U.S. Patent Application Ser. No. 744,018 now U.S. Pat. No. 4,144,371 (Flattened and Bonded Fabric of Foamed Vinyl Plastisol on a Filament Core and Method of Preparing Same-Okie et al), incorporated by reference herein, a multifilament strand, such as polyester, nylon, rayon or glass, is immersed in a liquid vinyl plastisol of relatively low viscosity (compared with the vinyl melt in an extruder), and the excess coating is wiped off by passing through a suitable orifice, such as a wire drawing die, to properly size the yarn. The strand is then passed through a heated oven to gel or solidify the coating. In this case, there will be a considerable amount of impregnation or penetration of the filament bundle by the vinyl, depending on the yarn twist and the viscosity temperature relationship of the plastisol. This impregnation or penetration is referred to as "wet-out".

A further modification can be made to yarns produced by extrusion coating and plastisol dip coating by incorporating a thermally activated chemical blowing agent in the vinyl formulation which remains latent during coating, but after the coated yarns are woven into fabric and heat-finished, decomposes at fabric finishing temperatures to yield an expanded cellular structure in the vinyl. One such blowing agent is azodicarbonamide, which decomposes between 302° and 392° F. The technology of yarns with latent foaming characteristics is described in the aforementioned U.S. Pat. No. 3,100,926 for extruded yarns, and in the aforementioned copending U.S. Patent Application Ser. No. 744,018 for plastisol dip yarns. As pointed out in Application Ser. No. 744,018, the latent foam feature allows the yarn produced by the plastisol dip process to undergo significant flattening during finishing due to the expanding vinyl being present among the filaments as previously described. In contrast, a yarn produced by the plastisol dip process, which does not contain a latent chemical blowing agent, has a finished width in a typical fabric of about half that containing a blowing agent. Even lacking the blowing agent, the plastisol dip coated yarn tends to flatten more than any equivalent diameter extrusion coated yarn, with or without blowing agent, because of the filament impregnation characteristic.

In fabrics woven from these types of yarns, it is often desirable to improve styling by utilizing a number of colors or patterns including solid colored stripes. A stripe effect can be introduced into the fabric by alternating groups of warp or filling yarns. A fabric embodying the subject invention produces a fabric appearance of solid stripes using latent foam vinyl coated yarns, particularly those yarns produced by the plastisol dip process. By using a clear vinyl coated yarn without a foam structure as a filling yarn, the solid stripe effect is closely approximated, especially if the filling yarn utilizes a polyester core fiber.

One such fabric is illustrated in FIG. 1, and is generally designated as 10. The fabric comprises a plurality of warp yarns 12 having a first color, a plurality of warp yarns 14 having a second color which is different from the first color, and a plurality of transparent filling yarns 16. All of these yarns are interwoven in accordance with a desired weave pattern, which, in this case, is a plain weave.

Figure 2:
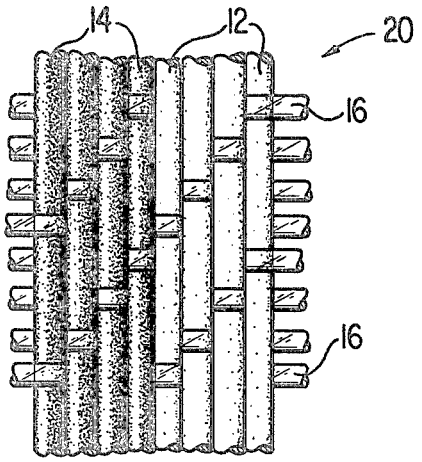
FIG. 2 is a plan view of another fabric embodying the subject invention.

An alternative fabric embodying the subject invention is illustrated in FIG. 2, and is generally designated as 20. Like yarns are denoted by the same reference numbers as FIG. 1. In this embodiment, however, the weave pattern used to generate the fabric is a satin weave. It is to be understood that the patterns illustrated in FIGS. 1 and 2 are provided by way of example, and that one skilled in the art may apply the teachings of the subject invention to countless other fabric patterns. Further, it has been found that the economic advantages associated with the teachings of the subject invention are maximized when producing fabrics having warp and fill densities of about 5 to 20 yarns per inch, with best results being obtained in the range of about 8 to 13 yarns per inch. These warp and fill densities are provided by way of example, and it should be understood that a fabric of any density will benefit from the teachings of the subject invention.

In a fabric made in accordance with the subject invention, a vinyl coated polyester core yarn is used as the transparent filling yarn. The core is made from a plurality of polyester filaments, wherein each filament typically has a transverse index of refraction of approximately 1.535. In the preferred embodiment of the subject invention, a vinyl resin compound having a refractive index of 1.53 to 1.54 was used. The vinyl resin compound used should combine the attributes of clarity, proper coating rheology, fusion and flow properties, while closely matching the transverse index of refraction of the polyester filaments.

An ideal situation occurs when the polyester filaments are completely wet-out by penetration with the vinyl, displacing the air at the filament's surface which significantly reduces the light refraction at the air/polyester interface and tends to make the polyester nearly invisible in the transparent vinyl. When a yarn, coated in such a manner, is woven as a filling yarn with a multicolor warp stripe, the highly transparent nature of the filling yarn lets the warp color show through at yarn crossover points thereby approximating the appearance of a solid stripe.

It has been found that the actual transparency of the transparent filling yarn is dependent upon several factors, including the degree of filament wet-out, the amount of occluded air present in the fused vinyl (air bubbles reduce transparency), and the degree of fusion of the vinyl (under-fused vinyl is less transparent). It has been observed that transparent yarns produced by the plastisol dip process are superior to extrusion coated yarns in that the polyester yarn filaments are less visible because the extrusion filaments have practically no vinyl penetration, and there is a high degree of refraction at the air/polyester interface, i.e., the air space being a void volume among the filaments in the core bundle.

By not having a foam structure in the transparent filling yarns, clarity is enhanced, and the width of the filling yarn is only half that of the warp foam yarns, further making the warp color predominant. It should be noted that the same size polyester core yarn can be used in the filling yarn, as well as in the warp yarns, with no loss in fabric strength properties.

Figure 3:
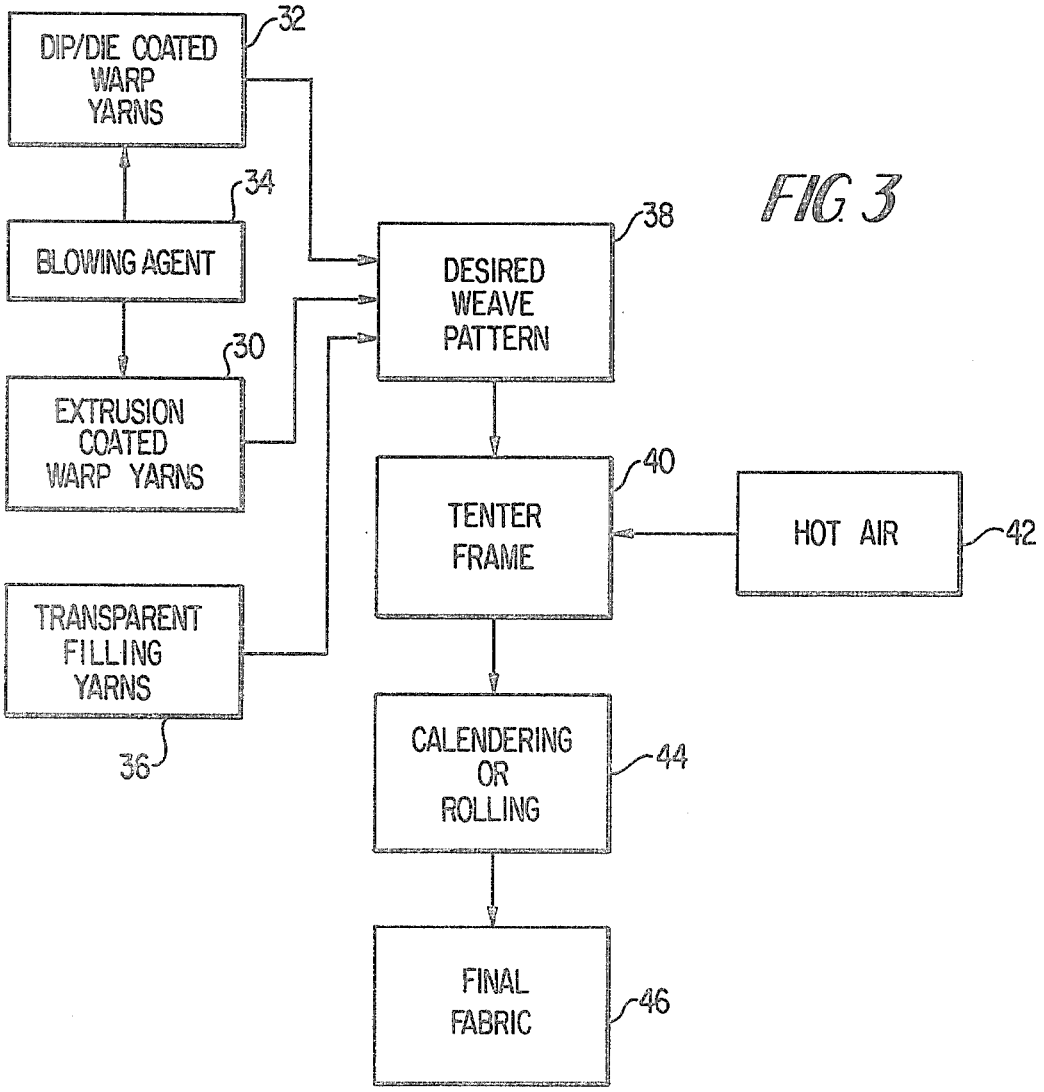
FIG. 3 is a flow diagram used in connection with a discussion of the method for making a fabric having a plurality of solid colored stripes.

In making a preferred fabric according to the teachings of the subject invention (see FIG. 3), the warp yarns are made from appropriately colored expansible threads formed by either the extrusion process 30 or the dip/die process 32. Each thread contains a multifilament polyester core, which is encapsulated in a mixture of thermoplastic resin, such as vinyl, and a thermally activateable blowing agent 34, such as azodicarbonamide. The filling yarns 36 are made from transparent threads. Each thread contains a transparent multifilament polyester core, which is encapsulated in a mixture of clear thermoplastic resin.

The warp yarns and transparent filling yarns are placed on a weaving machine, of any conventional type, and there woven into a fabric according to a desired weave pattern 38. The fabric is then passed through a tenter frame 40 at which time the fabric is held taut in both the fill and warp directions. Hot air 42, at approximately 375° F., is passed through the fabric causing the vinyl to soften and the blowing agent to release. The tensions being applied to the fabric cause the yarns to flatten at the points where warp and fill cross, bonding or welding taking place at each of these points. Further flattening can be accomplished by performing a calendering or rolling operation 44 on the fabric while it is still soft. The result of all of this is a generally planar fabric 46 having a plurality of solid colored stripes.

Obviously, many modifications and variations of the present invention are possible in light of the above teachings, and it is contemplated that, within the scope of the appended claims, the invention may be practised otherwise than as specifically described.

What is claimed is:

1. A planar fabric having opposed first and second faces, each face having a pattern of solid colored stripes, said fabric comprising: a first plurality of warp yarns having a first color; a second plurality of warp yarns having a second color different from said first color; and a plurality of transparent filling yarns, said warp yarns and said filling yarns being interwoven to create a plurality of yarn crossover points at which said transparent yarns allow the colors of said warp yarns to show through and to define the same pattern of solid color stripes on both faces of said fabric.

2. The fabric according to claim 1, wherein at least one of said warp yarns comprises a core fiber encapsulated in a thermoplastic resin.

3. The fabric according to claim 2, wherein said core fiber is a multifilament.

4. The fabric according to claim 2, wherein said core fiber is made from polyester, nylon, rayon or glass.

5. The fabric according to claim 3, wherein said multifilament is polyester.

6. The fabric according to claim 2, wherein said encapsulated yarn contains a thermally activated blowing agent.

7. The fabric according to claim 6, wherein said blowing agent is azodicarbonamide.

8. The fabric according to claim 1, wherein at least one of said filling yarns comprises a transparent core fiber encapsulated in a clear thermoplastic resin.

9. The fabric according to claim 8, wherein said core fiber is a polyester multifilament.

10. The fabric according to claim 9, wherein said polyester multifilament has a transverse index of refraction of about 1.535.

11. The fabric according to claim 8, wherein said clear resin has an index of refraction in the range of about 1.53 to 1.54.

12. The fabric according to claim 8, wherein said resin is a plastisol.

13. The fabric according to claim 12, wherein said plastisol is a vinyl plastisol.

14. The fabric according to claim 8, wherein said polyester filaments are wet-out by penetration of said thermoplastic resin.

15. The fabric according to claim 2, wherein at least one of said filling yarns comprises a transparent core fiber encapsulated in a clear thermoplastic resin.

16. The fabric according to claim 15, wherein all of said core fibers have substantially the same diameter.

17. The fabric according to claim 1, wherein the width of at least one said filling yarns is approximately one-half the width of at least one of said warp yarns.

18. The fabric according to claim 1, wherein said weave pattern is for a plain weave.

19. The fabric according to claim 1, wherein said weave pattern is for a satin weave.

20. A generally planar fabric having opposed first and second faces, each face containing a pattern of solid colored stripes, said fabric comprising:

a first plurality of warp yarns, at least one of said yarns including a core fiber encapsulated in a thermoplastic resin of a first color;

a second plurality of warp yarns, at least one of said yarns including a core fiber encapsulated in a thermoplastic resin of a second color different from said first color; and a plurality of transparent filling yarns, at least one of said yarns including a transparent core fiber encapsulated in a clear thermoplastic resin, said warp yarns and said filling yarns being interwoven to create a plurality of yarn crossover points at which said transparent yarns allow the colors of said warp yarns to show through and to define the same pattern of solid color stripes on both faces of said fabric.

21. The fabric according to claim 20, wherein the core fiber of said encapsulated warp yarns is a multifilament.

22. The fabric according to claim 21, wherein said multifilament is made from polyester, nylon, rayon or glass.

23. The fabric according to claim 21, wherein said multifilament is made from polyester.

24. The fabric according to claim 23, wherein said thermoplastic resin of said encapsulated warp yarns is a plastisol.

25. The fabric according to claim 24, wherein said plastisol is a vinyl plastisol.

26. The fabric according to claim 20, wherein the core fiber of said encapsulated filling yarn is a transparent polyester multifilament.

27. The fabric according to claim 26, wherein said thermoplastic resin of said encapsulated filling yarn is a transparent plastisol.

28. The fabric according to claim 27, wherein said plastisol is a clear vinyl plastisol.

29. The fabric according to claim 28, wherein the transverse index of refraction of said core fiber is 1.535, and the index of refraction of said clear vinyl plastisol is in the range of about 1.53 to 1.54.

30. The fabric according to claim 20, wherein the thermoplastic resin of said encapsulated yarns contains a thermally activated chemical blowing agent.

31. The fabric according to claim 30, wherein said blowing agent is azodicarbonamide.

32. A method of making a planar, two-face fabric having a plurality of solid colored stripes on each face, the method comprising the steps of weaving in accordance with a desired weave pattern, a first plurality of warp yarns having a first color, a second plurality of warp yarns having a second color different from said first color, and a plurality of transparent filling yarns to create a plurality of yarn crossover points at which said transparent yarns allow the colors of said warp yarns to show through and to define the same pattern of solid color stripes on both faces of said fabric.

33. The method of claim 32 further comprising the step of selecting extrusion-coated yarns for said warp yarns.

34. The method of claim 32 further comprising the step of selecting dip/die coated yarns for said warp yarns.

35. The method of claim 32 further comprising the step of selecting transparent dip/die coated yarns for said filling yarns.

36. The method of claim 32, wherein said weave pattern is for a plain weave.

37. The method of claim 32, wherein said weave pattern is for a satin weave.

38. A method of making a planar, two-face fabric having a plurality of solid colored stripes, the method comprising the steps of weaving in accordance with a desired weave pattern, a first plurality of latent foam vinyl coated warp yarns of a first color, a second plurality of latent foam vinyl coated warp yarns of a second color different from said first color, and a plurality of transparent vinyl coated filling yarns to create a plurality of yarn crossover points at which said transparent yarns allow the colors of said warp yarns to show through and to define the same pattern of solid color stripes on both faces of said fabric.

39. The method according to claim 38 further comprising the steps of holding said fabric taut in both the fill and warp directions, passing hot air through said fabric to soften the vinyl in all yarns, to release a blowing agent in said latent foam vinyl yarns, and to bond and flatten all yarns at said crossover points.

40. The method according to claim 39 further comprising the steps of calendering said fabric while it is still soft.

41. The method according to claim 39 further comprising the step of rolling said fabric while it is still soft to further flatten said fabric.

42. A single layer, two-face fabric made from vinyl coated yarns, and having a pattern including bold solid color stripes of at least two different colors on at least one face thereof said fabric comprising:

a first plurality of vinyl coated warp yarns having a first color for defining one of said at least two bold solid color stripes;

a second plurality of vinyl coated warp yarns having a second color different from said first color for defining another of said at least two bold solid color stripes; and a plurality of transparent filling yarns interwoven with said warp yarns to create a plurality of yarn crossover points, said transparent filling yarns allowing the colors of said warp yarns to show through without detracting from the appearance of the bold solid color stripes defined by said warp yarns.

* * * * *